US005443380A

United States Patent [19]

Riehl

[11] Patent Number: 5,443,380

[45] **Date of Patent: * Aug. 22, 1995**

[54] BURNER CONSTRUCTION AND METHOD OF MAKING THE SAME

[75] Inventor: Fred Riehl, Greensburg, Pa.

[73] Assignee: Robertshaw Controls Company, Richmond, Va.

[ * ] Notice: The portion of the term of this patent subsequent to Jul. 12, 2011 has been disclaimed.

[21] Appl. No.: 270,449

[22] Filed: Jul. 5, 1994

Related U.S. Application Data

[60] Division of Ser. No. 147,662, Nov. 2, 1993, Pat. No. 5,328,358, which is a continuation of Ser. No. 942,424, Sep. 9, 1992, abandoned, which is a division of Ser. No. 795,106, Nov. 20, 1991, abandoned, which is a division of Ser. No. 710,657, Jun. 5, 1991, Pat. No. 5,083,915, which is a division of Ser. No. 508,799, Apr. 12, 1990, Pat. No. 5,040,970.

[51] Int. Cl.[6] ..... F23Q 3/00

[52] U.S. Cl. ..... 431/266; 126/39 E

[58] Field of Search ..... 431/263, 264, 266; 126/39 R, 39 E, 39 F, 39 H, 39 K

[56] References Cited

U.S. PATENT DOCUMENTS

| | | | |
|---|---|---|---|
| 1,004,291 | 9/1911 | Merrill | 239/427 |
| 4,773,389 | 9/1988 | Le Monnier de Gouville et al. | 126/39 R |
| 4,846,671 | 7/1989 | Kwiatek | 431/266 |
| 5,083,915 | 1/1992 | Riehl | 431/266 |
| 5,328,358 | 7/1994 | Riehl | 431/266 |

FOREIGN PATENT DOCUMENTS

| | | | |
|---|---|---|---|
| 2408096 | 7/1979 | France . | |
| 1109625 | 6/1961 | Germany | 431/343 |
| 605868 | 12/1958 | Monaco . | |
| 36302 | 8/1929 | Netherlands . | |
| 1370326 | 10/1974 | United Kingdom . | |
| 1450153 | 9/1976 | United Kingdom | 431/266 |

*Primary Examiner*—Carroll B. Dority
*Attorney, Agent, or Firm*—Candor, Candor & Tassone

[57] ABSTRACT

A burner construction and method of making the same are provided, the burner construction comprising a burner body having a chamber therein and having opposed ends one of which is open to the chamber and the other of which has structure for interconnecting a source of fuel to the chamber, and a removable cap closing the one end of the body, the cap having opposed sides and an annular peripheral edge interconnecting the opposed sides together, the burner construction having ports interconnecting the chamber to the exterior of the burner construction and through which the fuel can issue to burn externally to the burner construction, the cap having an annular groove in one of the opposed sides thereof and inboard of the peripheral edge thereof, the burner body having a projection disposed in the groove to hold the cap on the one end of the burner body in its closing position thereof.

7 Claims, 4 Drawing Sheets

BURNER CONSTRUCTION AND METHOD OF MAKING THE SAME

CROSS REFERENCE TO RELATES APPLICATIONS

This application is a divisional patent application of its parent patent application Ser. No. 147,662, filed Nov. 2, 1993, now U.S. Pat. No. 5,328,358, which, is turn, is a continuation application of its parent patent application, Ser. No. 942,424, filed Sep. 9, 1992, now abandoned, which, in turn is a divisional patent application of its parent patent application Ser. No. 795,106, filed Nov. 20, 1991, now abandoned, which, in turn, is a divisional patent application of its parent patent application Ser. No. 710,657, filed Jun. 5, 1991, now U.S. Pat. No. 5,083,915, which, in turn, is a divisional patent application of its parent patent application Ser. No. 508,799, filed Apr. 12, 1990, now U.S. Pat. No. 5,040,970.

BACKGROUND OF THE INVENTION

1. Field of the Invention

This invention relates to a new burner construction and to a new method of making such a burner construction.

2. Prior Art Statement

It is known to provide a burner construction comprising a burner body means having a chamber means therein and having opposed end means one of which is open to the chamber means and the other of which has means for interconnecting a source of fuel to the chamber means, and a removable cap means closing the one end means of the body means, the cap means having opposed sides and an annular peripheral edge means interconnecting the opposed sides together, the burner construction having port means interconnecting the chamber means to the exterior of the burner construction and through which the fuel can issue to burn externally to the burner construction. For example, see the U.S. Pat. to Merrill, No. 1,004,291 and the U.S. Pat. to Kwiatek, No. 4,846,671.

It is also known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the other of the opposed end means of the body means having a generally cylindrical portion having a free end and a fuel flow passage leading from the free end to the chamber means, and an orifice adaptor carried by the portion to feed fuel from the source into the passage at the free end of the portion. For example, see the aforementioned U.S. Pat. to Merrill, No. 1,004,291 and the aforementioned U.S. Pat. to Kwiatek, No. 4,846,671.

SUMMARY OF THE INVENTION

It is one feature of this invention to provide a new burner construction that utilizes unique means for locating the burner cap means in its proper position without requiring great manual dexterity.

In particular, it was found according to the teachings of this invention that the burner cap means can be provided with an annular groove means which will receive projection means of the burner body means therein so as to hold the cap means in its proper position on the burner body means.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the cap means having opposed sides and an annular peripheral edge means interconnecting the opposed sides together, the burner construction having port means interconnecting the chamber means to the exterior of the burner construction and through which the fuel can issue to burn externally to the burner construction, the cap means having an annular groove means in one of the opposed sides thereof and inboard of the peripheral edge means thereof, the burner body means having projection means disposed in the groove means to hold the cap means on the one end means of the burner body means in its closing position thereof.

It is another feature of this invention to provide a new burner construction that has unique spacing of the port means and the carry-over land means thereof so as to provide good combustion performance.

In particular, it was found according to the teachings of this invention that one of the body means and the cap means of the burner construction can have an annular surface means interrupted by a plurality of radially disposed groove means that are spaced apart by land means and that define a generally repeating pattern of a set of a certain number of the groove means and the land means separated from the next adjacent set of the certain number of the groove means and the land means by one of the land means that is not part of the sets and that has an annular or circumferential length that is longer than the annular or circumferential length of any one of the land means of the sets separated thereby.

For example, another embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, one of the body means and the cap means having an annular surface means interrupted by a plurality of radially disposed groove means that are spaced apart by land means of the annular surface means and that define a generally repeating pattern of a set of a certain number of the groove means and the land means separated from the next adjacent set of the certain number of the groove means and the land means by one of the land means that is not part of the sets and that has an annular length that is longer than the annular length of any one of the land means of the sets separated thereby and wherein the other of the body means and the cap means has an annular surface means cooperating with the annular surface means that has the groove means therein to close the groove means on one end thereof whereby the groove means define the port means.

It is another feature of this invention to provide a new burner construction that has unique igniter means for igniting the fuel issuing from the burner construction.

In particular, it was found according to the teachings of this invention that one of the land means that is disposed between a pair of groove means that form port means of the burner construction can have an igniter receiving slot means formed therein so that an igniter assembly can have a part thereof disposed in such slot means.

For example, another embodiment of this invention comprises a burner construction comprising a burner body means having a chamber means therein and having opposed end means one of which is open to the chamber means and the other of which has means for interconnecting a source of fuel to the chamber means, a removable cap means closing the one end means of the burner body means, the burner construction having port means interconnecting the chamber means to the exterior of the burner construction and through which the fuel can issue to burn externally to the burner construction, one of the body means and the cap means having an annular surface means interrupted by a plurality of radially disposed groove means that are spaced apart by land means of the annular surface means one of which has an igniter receiving slot means therein and wherein the other of the body means and the cap means has an annular surface means cooperating with the annular surface means that has the groove means therein to close the groove means on one end thereof whereby the groove means defines the port means, and an igniter assembly having a part thereof disposed in the slot means.

It is another feature of this invention to provide a new burner construction that is adapted to be installed with a remote coaxial orifice adaptor arrangement and has unique means for being converted so as to carry an orifice adaptor as a part thereof, if desired.

In particular, it was found according to the teachings of this invention that a unique generally U-shaped bracket can be detachably mounted to the burner body means of the burner construction and carry an orifice adaptor in the proper position for feeding fuel to the burner construction.

For example, another embodiment of this invention comprises a burner construction comprising a burner body means having a chamber means therein and having opposed end means one of which is open to the chamber means and the other of which has means for interconnecting a source of fuel to the chamber means, a removable cap means closing the one end means of the body means, the burner construction having port means interconnecting the chamber means to the exterior of the burner construction and through which the fuel can issue to burn externally to the burner construction, the other of the opposed end means of the burner body means having a generally cylindrical portion having a free end and a fuel flow passage leading from the free end to the chamber means, and an orifice adaptor carried by the portion to feed fuel from the source into the passage at the free end of the portion, the burner construction comprising a generally U-shaped bracket defined by two legs respectively interconnected to the portion of the body means and a cross member that interconnects the legs together and carries the orifice adaptor.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
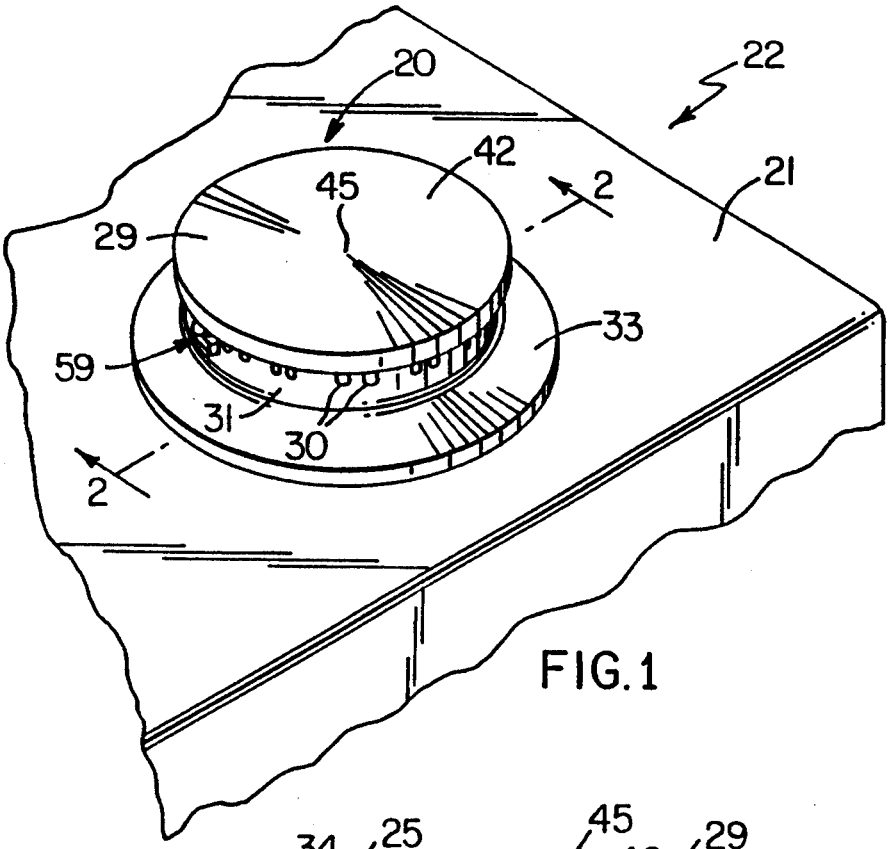
FIG. 1 is a fragmentary top perspective view illustrating the new burner construction of this invention mounted in a range top of a cooking apparatus.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

The burner construction of this invention is of a type that is similar to the burner constructions that are set forth in applicant's copending patent application, Ser. No. 448,935, filed Dec. 12, 1989. However, the burner construction of this invention has many features that are unique and are not provided in the burner constructions of such copending patent application as will be apparent hereinafter.

Figure 2:
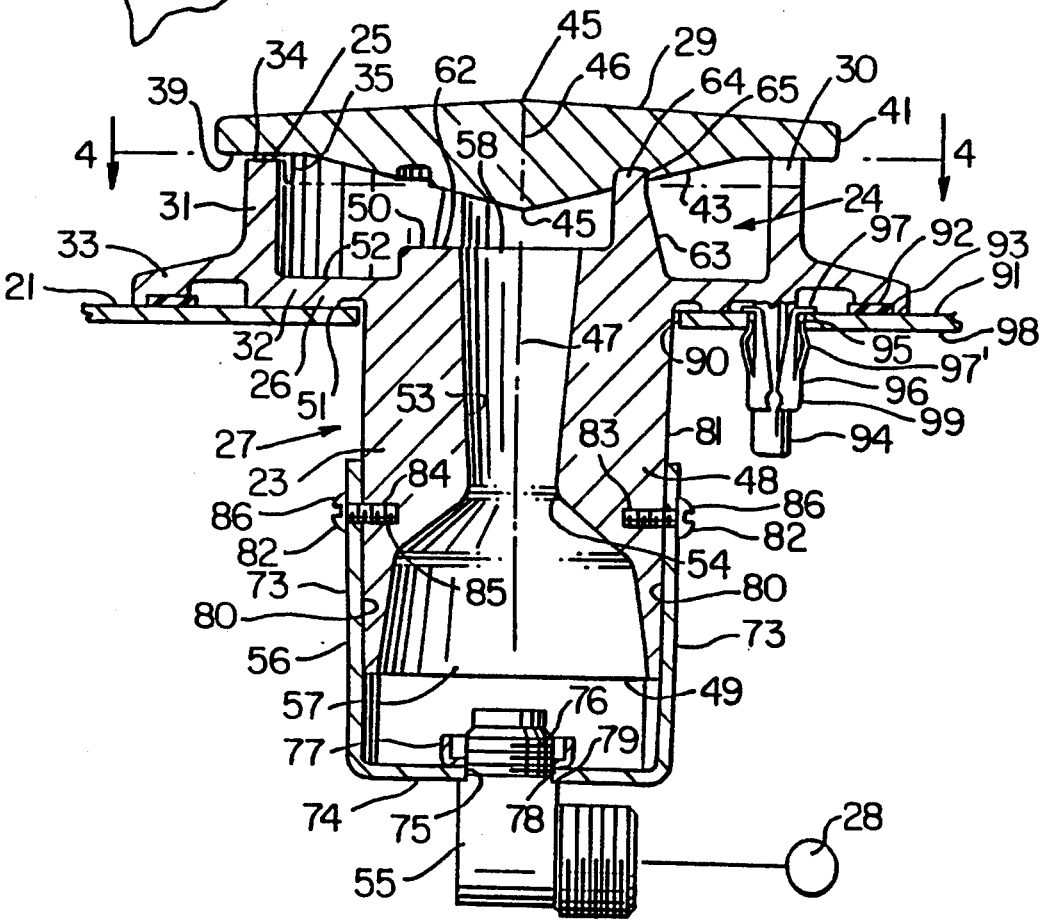
FIG. 2 is an enlarged fragmentary cross-sectional view taken on line 2—2 of FIG. 1.
Figure 3:
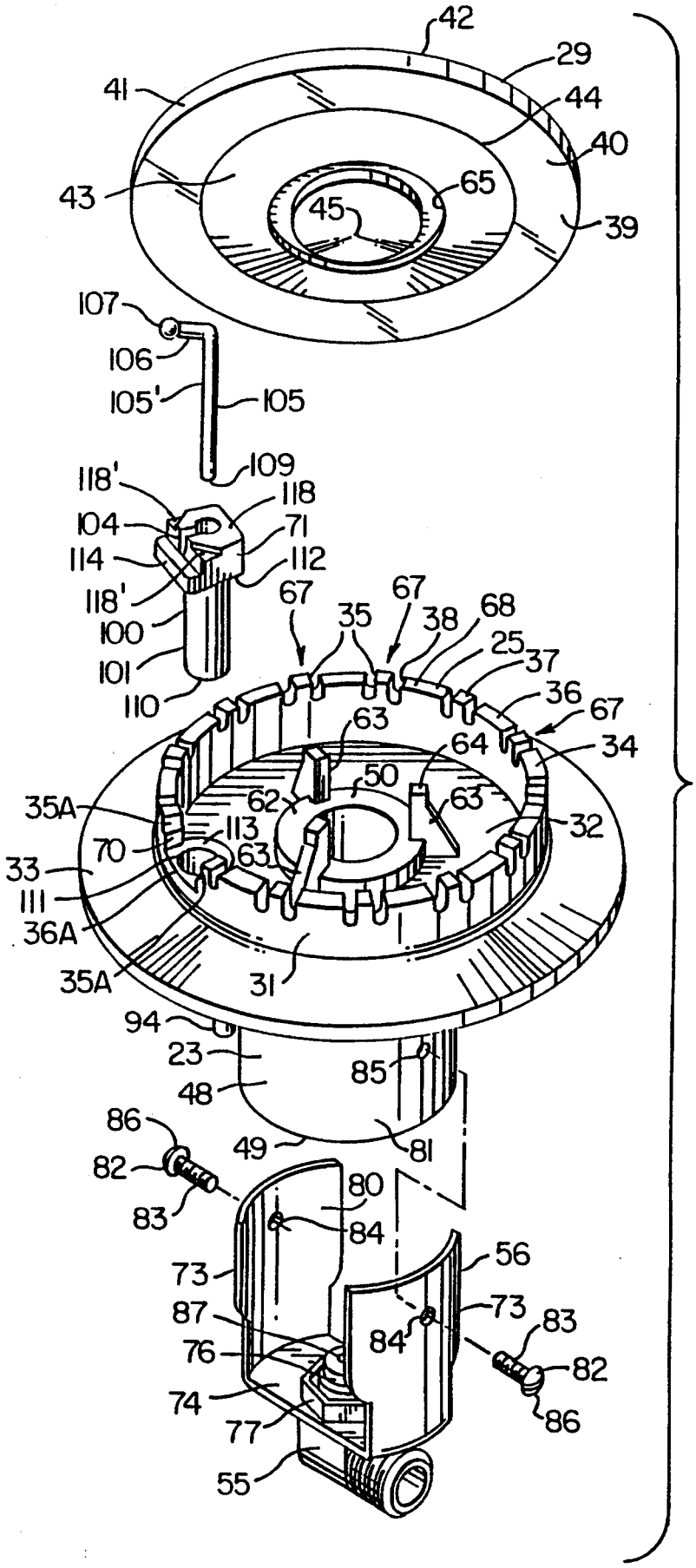
FIG. 3 is an exploded perspective view of the various parts of the burner construction of FIGS. 1 and 2.

Referring now to FIGS. 1–3, the new burner construction of this invention is generally indicated by the reference numeral 20 and is illustrated as being sealed to a range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a source 28 of fuel with the chamber means 24 in a manner hereinafter set forth.

The burner construction 20 comprises a removable cap means 29 closing the open end means 25 of the burner body means 23, the burner construction 20 having a plurality of port means 30 interconnecting the chamber means 24 to the exterior of the burner construction 20 and through which fuel can issue to burn externally to the burner construction 20 in a manner well known in the art. For example, see the aforementioned U.S. Pat. to Merrill, No. 1,004,291 and the aforementioned U.S. Pat. to Kwiatek, No. 4,846,671, whereby these two patents are being incorporated into this disclosure by this reference thereto.

While the burner body means 23 and removable cap means 29 of the burner construction 20 of this invention can be formed of any suitable material or combination of materials, such as metallic material, one working embodiment thereof has the body means 23 and cap means 29 each formed of die cast aluminum RMS-105 with the body means 23 being a one-piece member and with the open end means 25 thereof being defined by an annular wall 31 extending upwardly from a wall 32 that defines the closed end means 26 of the body member 23, the wall means 32 having an annular extension 33 for extending outboard of the upstanding annular wall 31 as illustrated.

In this manner, the two main parts of the burner construction 20, namely the burner body means 23 and the cap means 29 can be manufactured as two castings without machining processes and thereby having a reduced manufacturing cost.

Figure 4:
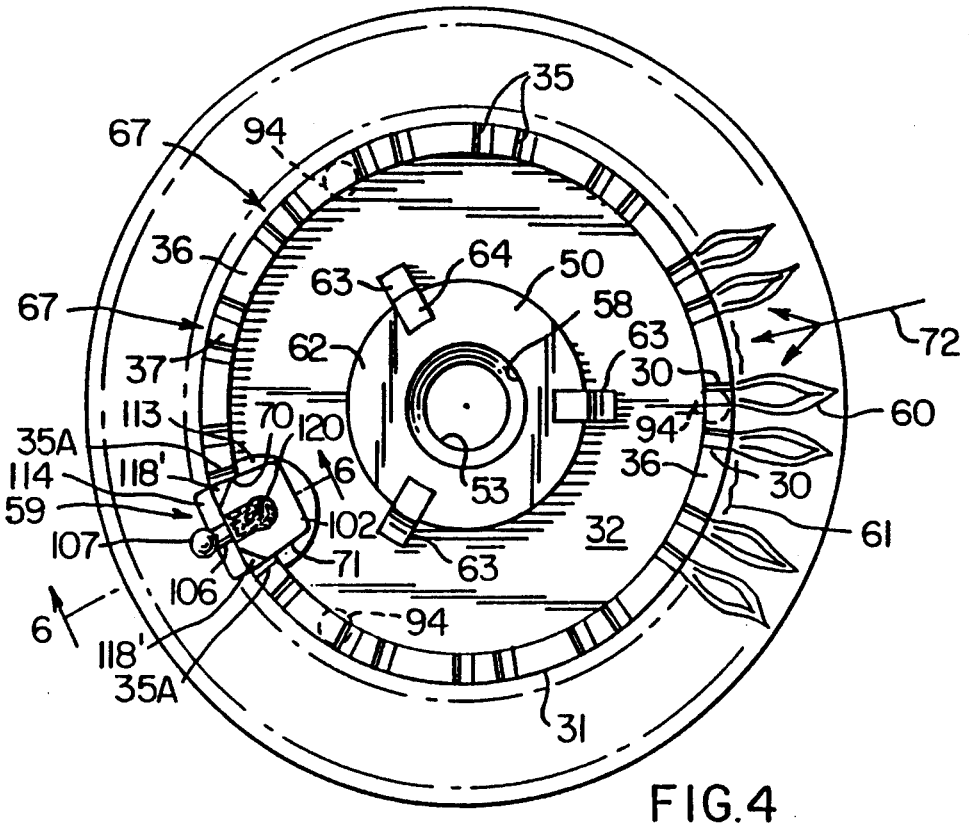
FIG. 4 is a cross-sectional view of the burner construction of FIG. 2 and is taken in the direction of the arrows 4—4 of FIG. 2.

The annular wall 31 of the body means 23 has an annular substantially flat top surface means 34 interrupted by a plurality of radially disposed and spaced apart U-shaped grooves 35 disposed in the circular array pattern as illustrated in FIGS. 3 and 4, the groove means 35 being separated by ungrooved land means 36 and 37 of the annular surface means 34 in a unique pattern arrangement that will be hereinafter set forth.

Figure 5:
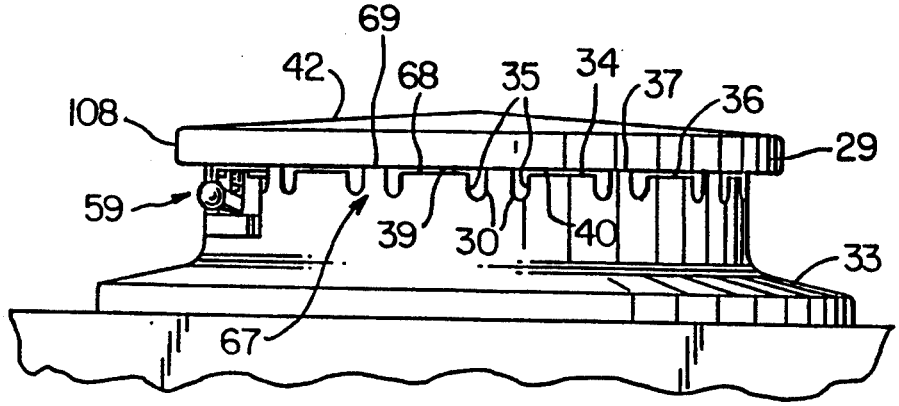
FIG. 5 is a fragmentary side view of the burner construction of FIG. 1 and illustrates the igniter assembly thereof.

The grooves 35 in the body member 23 are adapted to be respectively closed at the open ends 38 thereof by a substantially flat annular surface means 39 formed on a side 40 of the cap means 29 when the cap means 29 is disposed in its closing position on the open end 25 of the burner body means 23 in the manner illustrated in FIGS. 2 and 5 so as to cooperate with the grooves 35 to define the port means 30 previously set forth.

The cap means 29 has an annular peripheral edge means 41 that interconnects the side 40 of the cap means 29 with an opposed side 42 thereof, the side 42 being generally conical and the side 40 having a central conical portion 43 that has its larger base 44 joining with the flat annular portion 40 thereof as illustrated whereby the respective apexes 45 of the conical side 42 and of the conical section 43 of the side 40 define a center axis 46 of the cap means 29 that is disposed substantially coaxial with a longitudinal axis 47 of the burner body means 23 as illustrated in FIG. 2 when the cap means 29 is in its closed position on the burner body mean s 23.

The burner body means 23 has the means 27 thereof comprising a cylindrical portion 48 extending from the closed end 26 thereof and being substantially coaxial with the longitudinal axis 47 of the burner body means 23, the cylindrical portion 48 having opposed free end means 49 and 50 respectively extending from opposed sides 51 and 52 of the wall 32 and being respectively interrupted by a passage means 53 passing longitudinally therethrough and defining an intermediate Venturi throat portion 54 for a purpose well known in the art. In this manner, an orifice adaptor 55 that is carried by a unique bracket structure 56 of this invention in a manner hereinafter set forth is adapted to direct fuel from the source 28 into an inlet end 57 of the passage means 53 to issue out of an outlet end 58 thereof into the chamber means 24 after passing through the Venturi throat means 54. Such fuel flowing into the chamber 24 passes out through the port means 30 to be ignited by an igniter assembly of this invention that is generally indicated by the reference numeral 59 and will be hereinafter set forth whereby the ignited fuel will propagate around the burner construction 20 to produce the flame pattern that is illustrated in FIG. 4 wherein main flames 60 are issuing from the port means 30 and carry-over flame means 61 are provided between each pair of adjacent flames 60 at the land means 36 in a unique manner hereinafter set forth.

The free end 50 of the portion 48 of the burner body means 23 defines an annular surface means 62 that surrounds the outlet end 58 of the passage 53 and extends beyond the surface 52 of the wall 32 as illustrated in FIG. 3. The burner body means 23 includes three uniformly spaced apart projections 63 disposed in a circular array about the free end 50 of the cylindrical portion 28 and having free end portions 64 which are adapted to be respectively received in an annular groove means 65 formed in the side 40 of the cap means 29, the groove means 65 being substantially concentric to the longitudinal axis 46 of the cap means 29 which joins the center points 45 thereof whereby the cap means 29 is axially oriented on the burner body means 23 in any desired rotational position thereof while still having the axis 46 thereof substantially coaxial with the axis 47 of the burner body means 23 so as to properly close the open ends 38 of the grooves 35.

Thus, it can be seen that the cap means 29 can be readily removed from the burner body means 23 and be readily replaced thereon in any rotational position thereof by having the free end means 64 of the projections 63 received in the annular groove means 65 in the manner illustrated in FIG. 2 without requiring great manual dexterity to properly orient the cap means 29 relative to the body means 23.

In addition, it has been found according to the teachings of this invention that the fingers or projections 63 provide obstructions to the fuel air mixture issuing out of the outlet end 58 of the passage means 53 into the chamber 24 of the burner construction 20 so as to provide for increased fuel air mixing of the primary air and the fuel through the resulting turbulence thereof caused by the obstructions 63 prior to the fuel air mixture exiting through the port areas 30 so that good combustion is provided by the burner construction 20 of this invention.

The groove means 35 that are formed in the wall 31 of the burner body means 23 to subsequently form the port means 30, are so constructed and arranged that the same define a substantially repeating pattern of a set 67 of two grooves 35 separated from each other by one land means 37 and then separated from the next set 67 of a pair of grooves 35 and their respective intermediate land means 37 by a large land means 36 that has an annular or circumferential length greater than the annular or circumferential length of each of the lands 37 of the two adjacent sets 67 as illustrated. In addition, the separating lands 36 each has a free end flat surface 68 that is recessed below the free end flat surfaces 69 of the lands 37 as will be apparent hereinafter so as to provide for the carry-over flame means 61 previously described.

One of the larger land means 36 of the burner construction 20 of this invention is indicated by the reference numeral 36A in FIG. 3 and part of the groove means 35A on each side of the land means 36A are cut away to form a substantially rectangular slot means 70 therein to receive an enlarged substantially rectangular end 71 of the igniter assembly 59 therein in the manner illustrated in FIGS. 4 and 6 and hereinafter set forth.

It has been found in one working embodiment of the burner construction 20 of this invention wherein the outer diameter of the wall 31 of the burner body means 23 at the annular surface means 34 is approximately 2.375 inches and the inner diameter of the wall 31 at the annular surface means 34 is approximately 2.125 inches, the grooves 35 each has a width at the open end 38 thereof of approximately 0.062 of an inch and a depth of approximately 0.115 of an inch while the U-shaped end thereof is defined by a radius that is one-half of the width of the respective groove 35. The outer surfaces 68 of the separating lands 36 are each recessed below the outer surfaces 69 of the lands 37 by approximately 0.015 of an inch. The annular or circumferential length of the surface 68 of each separating land 36 is approximately 0.315 of an inch and the annular or circumferential length of the surface 69 of each land 37 is approximetely 0.125 of an inch.

It has been found in the above working embodiment for the grooves 35 and lands 36 and 37 that the carry-over flames 61 between each set 67 of grooves 35 caused by the fuel flowing outwardly from the chamber 24 between the cap means 29 and the lowered surfaces 68 of the lands 36 are sufficient to propagate the main burner flames 60 around the burner circumference and do not interfere with the vital induction of secondary air at each land 36 as represented by the arrow 72 in FIG. 4 so as to complete combustion of the outer mantle of the main burner flames 60.

The unique bracket 56 of this invention comprises a U-shaped structure as illustrated in FIG. 3 that defines two legs 73 that are joined together by a cross member 74 that has an opening 75 passing centrally there-through and receiving a threaded end 76 of the orifice adaptor 55 there-through so that the orifice adaptor 55 can be fastened to the bracket 56 by a nut means 77 threaded on the threaded end 76 of the adaptor 55 to sandwich a peripheral edge means 78 of the cross member 74 of the bracket 56 between the nut 77 and an annular shoulder 79 of the orifice adaptor 55 in the manner illustrated in FIG. 2.

While the bracket 56 can be formed of any suitable material and in any suitable manner, one working embodiment of the bracket 56 comprises a sheet metal member that has been suitably cut, stamped and bent into the configuration illustrated.

The legs 73 of the bracket member 56 define arcuate inner surface means 80 that are adapted to mate with large areas of the cylindrical external peripheral surface means 81 of the portion 48 of the burner body means 23 in the manner illustrated in FIG. 2 and be detachably fastened directly thereto by threaded fastening members or screws 82 respectively having threaded shank portions 83 thereof passing through suitable openings 84 in the legs 73 and being received in threaded openings 85 formed in the portion 48 of the burner body means 23 in the manner illustrated in FIG. 2 wherein enlarged heads 86 of the fastening members 82 sandwich the legs 73 against the surface means 81 of the portion 48 of the burner body means 23 as illustrated in FIG. 2. Because of the relatively long arcuate inner surfaces 80 of the legs 73, it can be seen that the bracket member 56 cannot rotate about the axis of the fastening members 82 whereby the center or orifice opening 87, FIG. 3, of the orifice adaptor 55 will be substantially disposed coaxial with the longitudinal axis 47 of the passage 53 for proper injection of the fuel flow into the Venturi throat 54 of the passage means 53.

Figure 7:
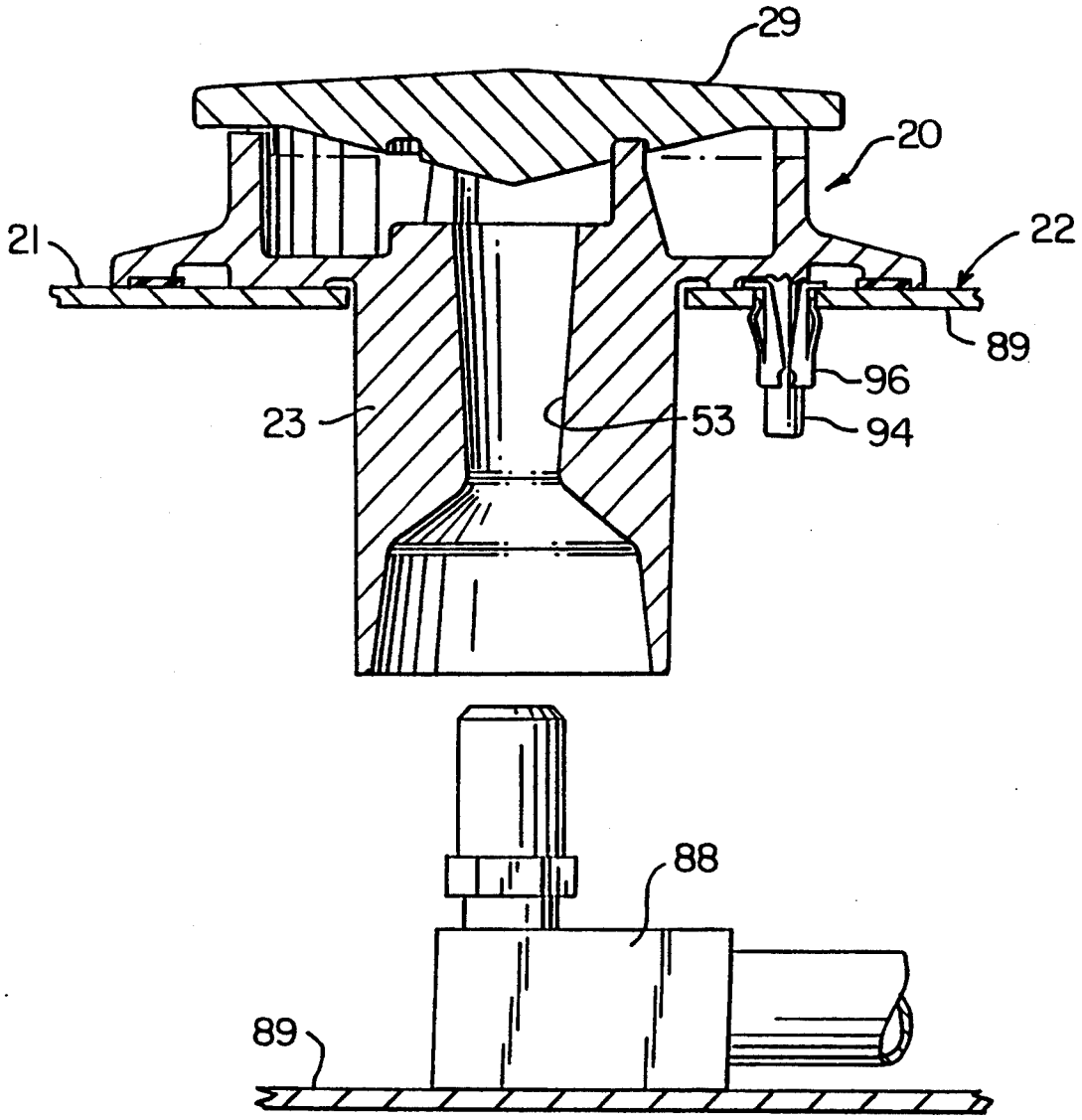
FIG. 7 is a view similar to FIG. 2 and illustrates the burner construction of this invention being utilized with a remote orifice adaptor.

However, it can readily be seen that the bracket member 56 can be readily detached from the burner body means 23 by removing the fastening members 82 whereby the burner body means 23 can be assembled to the top surface means 21 of the cooking apparatus 22 in the manner illustrated in FIG. 7 wherein the cooking apparatus 22 has an orifice adaptor means 88 mounted to a structure 89 of the cooking apparatus so as to be separate or remote from the burner construction 20 as illustrated in FIG. 7. In this manner, the premounted orifice adaptor 88 permits the fuel supply lines to be assembled to the cooking apparatus 22 and be leak tested prior to the placing of the burner constructions 20 of this invention in position on the top surface means 21 and the passage means 53 thereof will still be coaxially aligned with the remote orifice adaptors 88.

However, as fully illustrated in FIGS. 1–6, the burner construction 20 of this invention readily permits the bracket member 56 to be secured thereto by the two screws 82 to convert the burner assembly of FIG. 7 to an integral orifice burner design concept wherein the orifice adaptor 55 is carried by the bracket means 56 as previously set forth and as illustrated in FIG. 2.

While the burner body means 23 of the burner construction 20 of this invention can be mounted to the top surface means 21 of the cooking apparatus 22 in any suitable manner, the embodiment of the burner construction 20 illustrated in the drawings is adapted to have the portion 48 of the burner body means 23 inserted through a suitable circular opening 90 formed through a top wall 91 of the cooking apparatus 22 that has the top surface means 21 as illustrated in FIG. 2 and be sealed thereto by a conventional annular sealing means 92 received in a groove means 93 in the wall extension 33 as illustrated. If desired, the annular sealing means 92 can actually space the wall means 32 of the burner body means 23 slightly above the top surface 21 of the wall means 91 in order to prevent heat of the burner construction 20 being transferred by conduction to the wall 91 through intimate contact of the metallic material of the burner construction 20 with the wall means 91.

In any event, the wall means 32 of the burner body 23 has a plurality, such as three, of tapering projections 94 formed integrally therewith and extending downwardly therefrom so as to be adapted to pass through cooperating openings 95 through the wall 91 at the same time that the portion 48 of the burner body means 23 is being inserted through the large opening 90, the projections 94 being held in the inserted position thereof by conventional spring clip means 96 that respectively have enlarged flange means 97 resting on the top surface 21 of the wall means 91 and spring fingers 97' engaging against the under surface 98 of the wall means 91 so that the lower C-shaped split ends 99 thereof will respectively spring engage against the projections 94 to tend to prevent the same from being pulled out of the clip means 96 in a conventional manner for such type of clip means.

Thus, it can be seen that it is a relatively simple matter to first insert the clip means 96 through the opening means 95 in the wall means 91 of the cooking apparatus 22 and then push the projections 94 of the burner body means 23 through such clip means 96 as the cylindrical projection 48 of the burner body means 23 is being inserted through the main opening 90 so as to hold the burner body means 23 in the fully inserted condition illustrated in FIGS. 2 or 7.

However, as previously stated other means can be utilized to mount the burner body means 23 in the opening 90 of the cooking apparatus 22, as desired.

The unique igniter assembly 59 of this invention comprises a one-piece electrically insulating member 100, such as a suitable ceramic material known as L 5 Steatite, that has a cylindrical portion 101 extending from the enlarged rectangular head 102 thereof that actually has a generally frusto-conical profile when looking down on the same. The cylindrical portion 100 has an opening 103 passing completely therethrough and leading from a transverse groove 104 formed in the head 102 whereby an electrode wire 105 can have a body portion 105' thereof disposed through the opening 103 and an L-shaped bent end 106 that is angled upwardly received in the cooperating groove 104 as illustrated whereby a ball-like free end 107 of the electrode wire 105 will be disposed in a proper position for sparking to an adjacent part 108 of the grounded cap means 29 when electrical current is passed through the wire means 105 by suitable electrical lead means being attached to the end 109 of the wire means 105 which projects out of the lower end 110 of the insulating member 100 and is upset at 109' to prevent movement of the electrode wire means 105 relative to the ceramic member 100.

Figure 6:
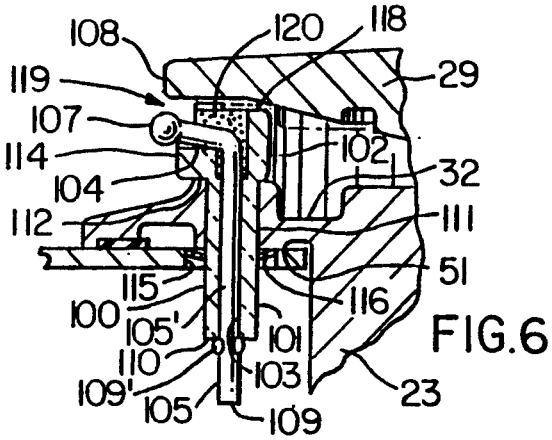
FIG. 6 is a fragmentary cross-sectional view taken on line 6—6 of FIG. 4 and illustrating the igniter assembly of the burner construction.

In order to mount the igniter assembly 59 in place, the wall 32 and land 36A are provided with a suitable opening means 111 passing therethrough and through which the cylindrical portion 101 of the member 100 can pass until the enlarged head 102 is received in the rectangular slot means 70 of the land means 36A by a lower surface 112 thereof abutting against the surface 113 of the land 36A as illustrated in FIG. 6. If desired, a portion or lip 114 of the enlarged head 102 can extend outwardly beyond the wall 31 of the burner body means 23 and beneath the electrode end 106 so as to prevent sparking from the ball end 107 of the electrode wire 105 to structure of the burner body means 23 that is located below the ball end 107 as illustrated.

The range top wall 91 has an opening 115 as illustrated in FIG. 6 so that the cylindrical portion 101 of the member 100 can pass readily therethrough, a spring clip 116 being telescopically disposed on the portion 101 to engage against the underside 51 of the wall 32 to hold the igniter assembly 59 in the assembled relation illustrated in FIG. 6.

The enlarged head 102 of the insulating member 100 of the igniter assembly 59 has a top surface 118 that is spaced below the side 40 of the cap means 29 and that has cutouts 118' therein at the forward edges thereof that feed fuel issuing from the chamber means 24 into the adjacent grooves 35A to a spark gap area 119 above the free end 107 of the igniter wire 105 so as to direct additional ignition fuel into the gap 119 to add to the ignition fuel issuing directly to the gap 119 over the top 118 of the member 100 from the chamber 24 so that sparking across the gap 119 will ignite the fuel issuing from the chamber means 24.

In addition, in order to confine the sparking to the gap 119 at the outer end 107 of the wire 105 so as to prevent sparking from a part of the electrode portion 106 to the cap means 29 inside the ceramic area, suitable ceramic potting material 120 can be disposed around bent portion 106 of the wire 105 adjacent to the ball end 107 thereof as illustrated.

Therefore, it can be seen that it is a relatively simple method of this invention to make the burner construction 20 with or without the orifice adaptor 55 to be readily mounted in a top surface means 21 of a cooking apparatus 22 as illustrated in FIGS. 2 or 7 so as to operate in a manner now to be described.

After the burner construction 20 has been mounted in the surface 21 of the cooking apparatus 22 either in the arrangement illustrated in FIG. 2 or in the arrangement illustrated in FIG. 7, suitable control means (not shown) will direct fuel from the fuel source 28 through the orifice adaptor 55 or the orifice adaptor 88 into the Venturi throat means 54 of the passage means 53 that causes primary air to be drawn into the passage means 53 in a manner well known in the art whereby the fuel air mixture is passed into the chamber means 24 where turbulence thereof is provided by the projections 63 in the manner previously described to provide for a good air fuel mixture before the fuel issues out of the port means 30 thereof. At the same time, other control means (not shown) provides for electrical sparking across the spark gap 119 of the ignition assembly 59 and cap means 29 so that fuel issuing over the top 118 of the igniter member 100 and out through the cutouts 118' of the igniter assembly 59 will be ignited by such sparking and then through flame propagation will spread completely around the burner construction 20 through the propagating flames 61 at the land means 36 and from flame means 60 to flame means 60 at the U-shaped grooves 35 in the manner previously described so that the burner construction 20 can be utilized for any desired purpose, such as a cooking purpose or the like. The igniter assembly 59 can be so controlled that the same would also provide for flame rectification in a manner well known in the art once the burner construction 20 has been ignited in the manner previously set forth.

Thus, it can be seen that the igniter assembly 59 of this invention provides the cutouts 118' to meter the fuel flow for ignition and shielding that will direct the ignition sparks to a specified ground location at the point 108 on the burner cap means 29 thereby ensuring a proper fuel mix and predictable spark for ignition of the same. Thereafter, rectification of the igniter probe 105 is achieved by the external design of the ceramic member 100 at the enlarged head 102 thereof so as to provide electrical conduction with the minimum stable turn down flame size.

Of course, when the control means disconnects the fuel source 28 from the orifice adaptor 55 or the orifice adaptor 88, fuel ceases to issue from the port means 30 and thereby the burner construction 20 is turned off.

Thus, it can be seen that this invention provides a new burner construction and a new method of making such a burner construction that will perform well with natural and LP fuels in the sealed burner applications thereof.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, the improvement wherein said body means has an annular surface means interrupted by a plurality of radially disposed groove means that are spaced apart by land means of said annular surface means and that define a generally repeating pattern of a set of a certain number of said groove means and said land means separated from the next adjacent set of said certain number of said groove means and said land means by one of said land means that is not part of said sets and that has an annular length that is longer than the annular length of any one of said land means of said sets separated thereby and wherein said cap means has an annular surface means cooperating with said annular surface means that has said groove means therein to close said groove means on one end thereof whereby said groove means define said port means, said annular surface means that has said groove means therein having an igniter receiving slot means therein, said slot means in effect causing a side of each of the two said groove means that are respectively disposed at opposite ends of said slot means to be missing, and an igniter assembly having a part thereof disposed in said slot means and defining the missing side of each of the two of said groove means that are respectively disposed on opposite sides of said igniter assembly.

2. A burner construction as set forth in claim 1 wherein each said set comprises two groove means separated by one land means.

3. A burner construction as set forth in claim 2 wherein each said groove means has a generally U-shaped configuration throughout the radial length thereof.

4. A burner construction as set forth in claim 1 wherein each said land means has a free end surface means that faces said annular surface means of said cap means, said free end surface means of each of said land means that are not part of said sets being spaced from said annular surface means of said cap means a greater distance than the distance said free end surface means of each of said land means of said sets is spaced from said annular surface means of said cap means.

5. A burner construction as set forth in claim 1 wherein said igniter assembly comprises an electrically insulating body member having an enlarged end that is disposed in said slot means, said igniter assembly comprising an electrically conductive member carried by said body member and having an end extending out of said enlarged end of said body member.

6. A burner construction as set forth in claim 5 wherein said enlarged end of said body member has flat surfaces respectively defining said missing sides of said two of said groove means.

7. In a method of making a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, the improvement comprising the steps of forming said body means to have an annular surface means interrupted by a plurality of radially disposed groove means that are spaced apart by land means of said annular surface means and that define a generally repeating pattern of a set of a certain number of said groove means and said land means separated from the next adjacent set of said certain number of said groove means and said land means by one of said land means that is not part of said sets and that has an annular length that is longer than the annular length of any one of said land means of said sets separated thereby, forming said cap means to have an annular surface means cooperating with said annular surface means that has said groove means therein to close said groove means on one end thereof whereby said groove means define said port means, forming said annular surface means that has said groove means therein to have an igniter receiving slot means therein that in effect causes a side of each of the two said groove means that are respectively disposed at opposite ends of said slot means to be missing, and disposing part of an igniter assembly in said slot means so that said igniter assembly defines the missing side of each of the two of said groove means that are respectively disposed on opposite sides of said igniter assembly.

* * * * *